US006565337B2

(12) United States Patent
Henderson

(10) Patent No.: US 6,565,337 B2
(45) **Date of Patent: *May 20, 2003**

(54) METHOD AND APPARATUS FOR INSPECTING VANES IN A ROTARY PUMP

(76) Inventor: Timothy H. Henderson, 2041 Cullen Rd., Gibsonville, NC (US) 27249

( * ) Notice: Subject to any disclaimer, the term of this patent is extended or adjusted under 35 U.S.C. 154(b) by 0 days.

This patent is subject to a terminal disclaimer.

(21) Appl. No.: 10/195,784

(22) Filed: Jul. 15, 2002

(65) Prior Publication Data

US 2003/0012671 A1 Jan. 16, 2003

Related U.S. Application Data

(63) Continuation of application No. 09/767,763, filed on Jan. 23, 2001, now Pat. No. 6,450,789.

(51) Int. Cl.[7] ..... F04C 2/344
(52) U.S. Cl. ..... 418/1; 418/2
(58) Field of Search ..... 418/1, 2, 252

(56) References Cited

U.S. PATENT DOCUMENTS

| | | | | |
|---|---|---|---|---|
| 706,158 A | | 8/1902 | Charles | |
| 2,781,000 A | * | 2/1957 | Thomas et al. | 418/252 |
| 3,036,527 A | * | 5/1962 | Peterson | 418/252 |
| 3,191,852 A | | 6/1965 | Kaatz et al. | |
| 3,301,194 A | | 1/1967 | Brunson | |
| 3,398,884 A | | 8/1968 | Kaatz et al. | |
| 3,463,384 A | | 8/1969 | Kilbane | |
| 3,469,500 A | | 9/1969 | Lutz et al. | |
| 3,552,895 A | | 1/1971 | Bayley | |
| 3,565,558 A | | 2/1971 | Tobacman | |
| 4,804,317 A | | 2/1989 | Smart et al. | |
| 4,820,140 A | | 4/1989 | Bishop | |
| 5,318,409 A | | 6/1994 | London et al. | 417/53 |
| 5,720,598 A | | 2/1998 | de Chizzelle | 417/53 |
| 6,318,147 B1 | | 11/2001 | Steinruck et al. | 73/7 |
| 6,368,066 B2 | | 4/2002 | Aiyama et al. | 417/63 |

FOREIGN PATENT DOCUMENTS

| | | | |
|---|---|---|---|
| AU | 82659/91 | * 10/1991 | 418/252 |

* cited by examiner

*Primary Examiner*—John J. Vrablik
(74) *Attorney, Agent, or Firm*—Adams, Schwartz & Evans, P.A.

(57) ABSTRACT

The present invention is directed to an apparatus and method for determining vane wear in rotary vane pumps that operate using slideable vanes. A view port is formed in an end of the pump housing. The view port is dimensioned such that a width of the port represents a predetermined amount of vane length loss. The view port is positioned in relation to the slots such that an end of the vane not in engagement with the wall of the pump will appear in the port only after a predetermined amount of vane loss occurs, and relative to the slots and the vanes to allow a determination of vane length for each vane when the vane is in engagement with the wall. The present invention also contemplates a method where a technician can determine the amount of wear, rate of wear and approximate number of hours of use left for the pump by rotating the rotor so that the vane in the slot will come into contact with the wall, and determining a remaining useable life for the vane based on a position of the vane in the view port and a known number of hours that the pump has been in use.

12 Claims, 3 Drawing Sheets

METHOD AND APPARATUS FOR INSPECTING VANES IN A ROTARY PUMP

RELATION TO PRIOR APPLICATION

This application is a continuation of U.S. patent application Ser. No. 09/767,763 filed Jan. 23, 2001, U.S. Pat. No. 6,450,789, under the same title.

FIELD OF THE INVENTION

The present invention relates to rotary vane pumps having self-lubricating sliding vanes. More particularly, the present invention is directed to a method and apparatus for inspecting the sliding vanes in a rotary vane pump to determine the amount of wear to the vanes without having to disassemble the pump housing.

BACKGROUND OF THE INVENTION

Sliding rotary vane pumps have been used for several years for a multitude of mechanical and industrial applications and can be exposed to a wide range of environmental conditions. These pumps can be used in both gas and liquid pumping applications. One type of sliding rotary vane pump is a dry air pump. In the general aviation field prior to the early 1960's, the vacuum systems which powered gyros were driven by pumps which were lubricated by oil and referred to in the art as wet pumps. In the 1960's, the oil lubricated, or wet vane vacuum pumps, were replaced by dry vacuum pumps constructed of carbon vanes and rotors which were self-lubricating. To this present day, the standard dry vacuum pumps in the market comprise mechanical carbon rotors and vanes operating in a hardened metal ellipsoidal cavity. These pumps provide a power source for, among other things, gyroscopically controlled, pneumatically operated flight instruments.

A dry air type rotary vane pump usually has a rotor with slots with a radial component of alignment with respect to the rotor's axis of rotation, vanes which reciprocate within these slots, and a chamber contour within which the vane tips trace their path as they rotate and reciprocate within their rotor slots. The reciprocating vanes thus extend and retract synchronously with the relative rotation of the rotor and the shape of the chamber surface in such a way as to create cascading cells of compression and/or expansion, thereby providing the essential components of a pumping machine.

Because dry air pumps do not use a liquid lubricant, other forms of dry lubrication have been developed. For example, vanes for rotary pumps have been manufactured from carbon material as disclosed in U.S. Pat. No. 3,191,852 issued to Kaatz, et al. on Jun. 29, 1965. These vanes are fabricated by compressing carbon, graphite and various organic binders under high pressure and temperature. U.S. Pat. No. 4,804,317 issued to Smart, et al. on Feb. 14, 1989, a carbon composite material has been used for the side plates and vanes of the rotary pump. A composite carbon part is fabricated by combining carbon based tensile strength fibers (in a cloth weave) with graphite and an organic binder. Although providing improved performance over the prior carbon parts, similar wear, chipping and fracture problems exist with composite carbon parts. U.S. Pat. No. 4,820,140 issued to Bishop on Apr. 11, 1989, discloses a self-lubricating coating applied to the pump parts to inhibit wear between the slideable vanes and pump rotor. The coating is comprised of a mixture of lead and polytetrafluoroethylene deposited on the surface of the part to be coated.

While these lubricating methods work well for dry pump applications, the nature of the vane lubrication technique is destructive to the pump. Certain parts of these pumps are made of carbon or carbon graphite. These parts rub against other stationary or moving parts of the pump during operation. Graphite from these parts is deposited on the opposing parts by the rubbing action and forms a low friction film between the parts, thereby providing lubrication. The deposited graphite film is itself worn away by continued operation of the pump, and is eventually exhausted out of the pump. The film is replaced by further wear of the carbon graphite parts. Thus, lubrication is provided on a continuous basis that continuously wears away the carbon graphite parts. The vanes of the pump require and provide the majority of lubrication. Therefore, the vanes wear and lose length as the pump operates. At some point in time, the length of the vanes will become so short that they will not slide properly in the slot, which may lead to pump failure.

Failure of a dry air pump while in service can render one or more aircraft systems inoperative. In addition, most pump failures occur in flight. Dry air pump performance is generally unaffected by wear on the vanes until total failure. Moreover, pump efficiency does not typically degrade enough to be noticed by the pilot until total failure occurs. Usually, pump operation is monitored based on the aircraft's vacuum gauge. If the pump is not operating correctly, the vacuum gauge will indicate such. However, this generally does not occur until near complete failure of the pump.

A correlation exists between the remaining length of the vanes and the expected future operational life of the pump. The inventor has determined that the incidence of structural failure of the vane/rotor combination begins to increase appreciably after the vanes wear to a certain length. The incidence of failures continues to increase and the rate of failure per unit time increases dramatically as the vanes continue to wear shorter.

The inventor has studied various dry air pump failures and determined that until the vane reaches about 74% of its original length, failure due to mechanical malfunction arising from reduced vane length is unlikely. The total failure rate from all causes for pumps with vanes having remaining lengths about equal to or greater than 74% is less than about 5% of the operating population. By the time remaining vane length reaches about 64% of the original length, about 50% of installed pumps have failed, and more than 90% of those failures can be traced to malfunctions relating to vane length. When the remaining vane length falls below 64% of the original length, more than 98% of the installed pumps studied have failed, and 95% of those failures are related to vane length.

While vane wear occurring as a result of graphite deposition for lubrication is normal, fairly predictable, and reasonably slow, vane wear can be accelerated if the carbon graphite parts rub against roughened interior surfaces of the pump. Roughness of the interior surfaces can occur through many different causes, such as elevated temperatures and pressures, dirty filters, etc. Regardless of whether the vane wear is normal, or abnormally accelerated, when the vane length reaches a certain percentage of the original length, the likelihood of pump failure increases significantly.

The current state of the art relating to dry air pump performance and efficiency does not adequately address how to determine when the vanes of the pump have reached a point requiring pump replacement or repair. Presently, there is no effective and simple way to inspect the state or rate of wear of the vanes in this type of pump. There is also no simple and cost effective way to determine the remaining useful life of a dry air pump. Currently, to ensure proper pump performance, the operation time for dry air pumps is monitored. When the number of hours of pump usage reaches a predetermined and arbitrary figure, the pump is removed and a new pump is installed. This is neither cost effective nor efficient since the pump may have a significant amount of usage time still available, or, if wear was abnormally fast, would not be done in time.

What is lacking in the art is a simple and inexpensive way of determine vane length in a pump to determine the state of wear, the rate of wear, and potential remaining life of dry air rotary pump vanes. Such a feature would allow, in some cases, a knowledgeable technician to determine whether other pump or related system failures or malfunctions are attributable to vane length. Thus, opportunity arises to remove from service pumps likely to fail. In addition, opportunities arise to make adjustments or repairs to related aircraft systems to correct other malfunctions determined by inspection of the dry air pump. By correcting system malfunctions that might cause the pump to operate in an overload condition, pump life may be extended, and unscheduled downtime for the aircraft can be avoided.

SUMMARY OF THE INVENTION

In view of the foregoing, it is an object of the present invention to provide an improved way to determine the remaining useful life of a rotary vane pump without having to disassemble the pump to make that determination. More particularly, it is an object of the present invention to provide a way to view the vanes within rotary pumps, and particularly dry air pumps, without having to disassemble the pump.

It is a further object of the present invention to provide a physical modification to a rotary pump housing to allow a visual determination of vane length, and to permit the determination state of vane wear, the rate of vane wear and to assess the potential remaining life of the rotary pump.

It is yet a further object of the present invention to provide a method for assessing the remain life of a rotary pump by viewing the length of the vanes in the pump without having to disassemble the pump.

To achieve these and other advantages the invention provides for a rotary vane pump, having a housing containing a bore forming an interior wall, an inlet port, and an outlet port. A rotor is rotationally mounted within the bore and has a plurality of circumferentially spaced, radially extending slots formed therein. A equal number of vanes of a predetermined length are slideably positioned within the slots. A drive attachment is coupled to the rotor to rotationally drive the rotor in the bore thereby urging the vanes radially outwardly and into engagement with the wall to form at least one pumping chamber. A view port is formed in an end of the housing. The view port is positioned relative to the slots and the vanes to allow a determination of vane length for each vane when the vane is in engagement with the wall.

The present invention is also directed to a method for modifying a rotary vane pump to determine the amount or rate of wear of vanes in the pump. The method includes determining a position at an end of a housing of the rotary vane pump. This position should allow for the visual determination of vane length for the vanes within the housing when the vanes are in contact with an inner wall of the housing. The method also includes forming a view port at the determined position, and forming a gauge port within the view port. The gauge port is dimensioned such that a width of the gauge port represents a predetermined amount of vane length loss.

The invention also contemplates a method for determining the remaining amount of useable life of a vane in a rotary vane pump. According to this aspect of the invention, the rotary vane pump comprises a housing containing a bore forming an interior wall, an inlet port, and an outlet port. A rotor is rotateably mounted within the bore. The rotor has a plurality of circumferentially spaced, radially extending slots formed therein, and an equal number of vanes of a predetermined length slideably positioned within the slots. A drive attachment is coupled to the rotor to rotationally drive the rotor in the bore thereby urging the vanes radially outwardly and into engagement with the wall to form at least one pumping chamber.

The method according to this aspect of the invention includes forming a view port at a predetermined position in an end of the housing, the view port being dimensioned such that a width of the port represents a predetermined percentage of vane length loss. The method also includes positioning the view port in relation to the slots such that an end of the vane not in engagement with the wall will appear in the port only after a predetermined amount of vane loss occurs. Thereafter, the method contemplates rotating the rotor so that the vane in the slot will come into contact with the wall, and determining a remaining useable life for the vane based on a position of the vane in the view port and a known number of hours that the pump has been in use.

Other objects and advantages of the invention will be apparent from the description of the preferred embodiments or may be learned by practice of the invention.

BRIEF DESCRIPTION OF THE DRAWINGS

In order that the invention will become more clearly understood it will be disclosed in greater detail with reference to the accompanying drawings, in which.

DESCRIPTION OF THE PREFERRED EMBODIMENT

Figure 1:
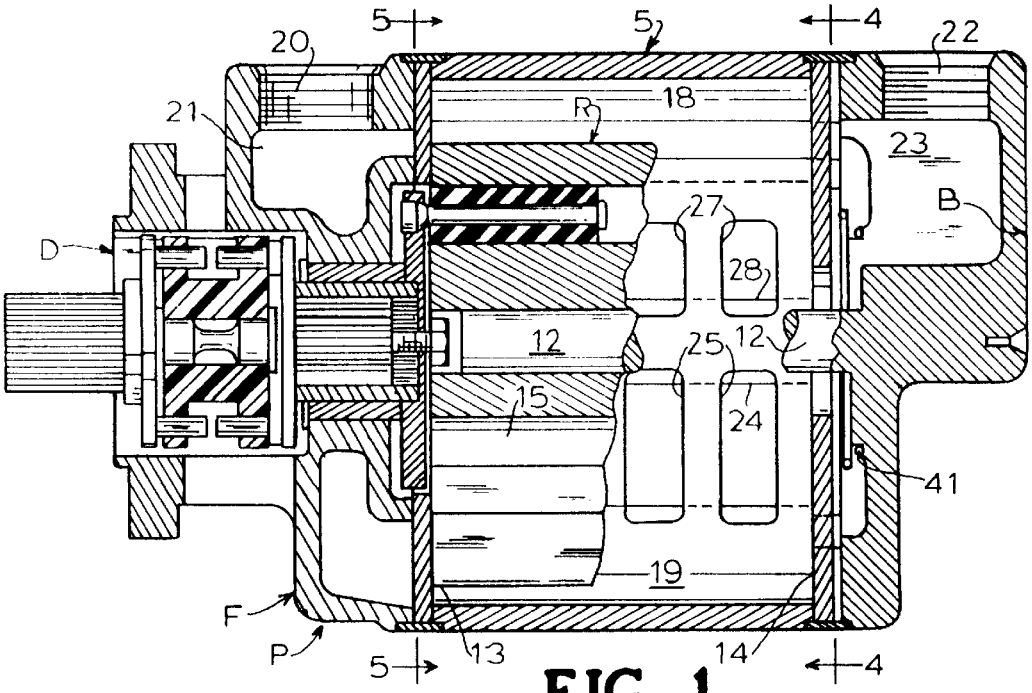
FIG. 1 is a longitudinal sectional view through the centerline of a known rotary pump.

FIGS. 1–5 illustrate various views of a known rotary vane-type pump suitable for the present invention. As illustrated in FIG. 1, the rotary vane-type pump P has a central annular body or stator S, a rotor R, a front flange F secured to an inlet end of stator S, a back flange B secured to the outlet end of stator S, and a drive assembly D mounted on the front flange F for driving rotor R.

Front flange F and back flange B can be secured to stator S by any known type of securing device as long as the pump parts S, F, and B are securely held in place during operation.

Figure 2:
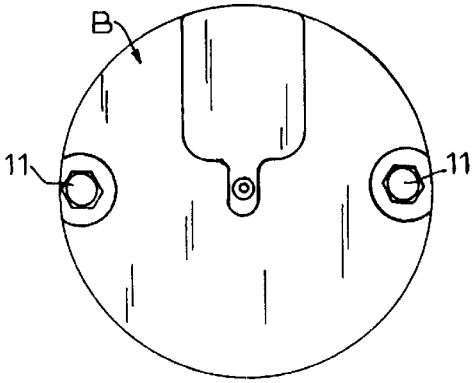
FIG. 2 is an end elevation from the rear end of the rotary pump of FIG. 1.
Figure 3:
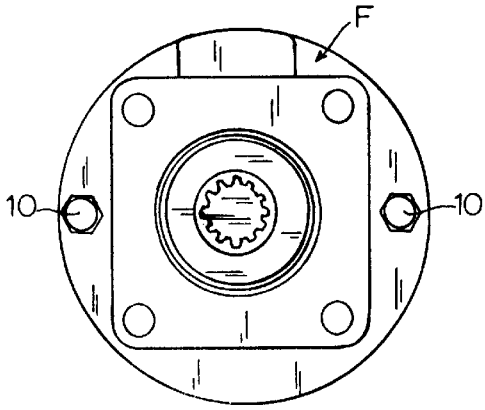
FIG. 3 is an end elevation from the front end of the rotary pump of FIG. 1.

FIGS. 2 and 3 illustrate the back flange B and front flange F being secured to stator S by two sets of screws 10 and 11, respectively. Each set of screws 1 0 and 11 are diametrically opposed on back flange B and front flange F. Preferably, back flange B and front flange F are mounted to stator S such that screws 10 are coaxially aligned with screws 11.

Figure 8:
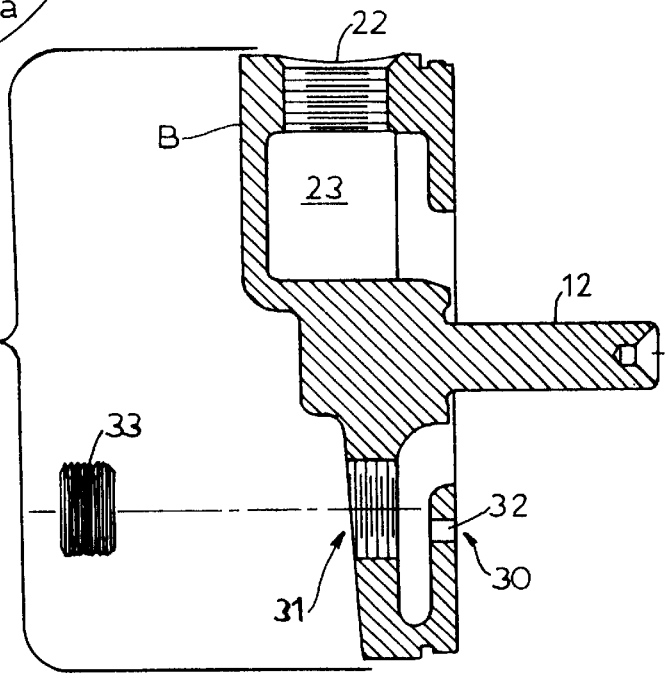
FIG. 8 is a side view of a rear flange of a rotary pump according to another aspect of the present invention.

Back flange B is provided with a central stud 12 which extends into and at least partially through stator S to provide a journal for rotor R. The forward end of rotor R rests against an inlet plate 13 of annular form interposed between front flange F and stator S. The opposite end of stator S rests against a floating end plate 14 interposed between stator S and back flange B. Alternatively, back flange B can be secured directly to stator S without interposing an intermediate plate. FIG. 8 illustrates a back flange B that can be secured directly to stator S.

Rotor R has a central bore that receives journal 12, and which provides a bearing surface for rotary movement of rotor R about its central axis. In the illustrated embodiment, rotor R is provided with six circumferentially spaced vane slots 15 that are angled slightly from a radial direction, and extend over the entire longitudinal length of rotor R. Each slot 15 receives a vane 16, which slides in and out of slot 15 as rotor R is rotationally driven about its center axis.

Each vane 16 is preferably made from a material that during use, wears and produces a form of dry lubrication for the pump P. For example, vanes 16 can be made from carbon material, graphite, and various organic binders. A self-lubricating coating may be applied to the pump parts to inhibit wear between the slideable vanes and pump rotor. In addition, each vane 16 can be provided with a metal jacket 17 to enhance strength. The jacket is not essential to the present invention, however.

Figure 4:
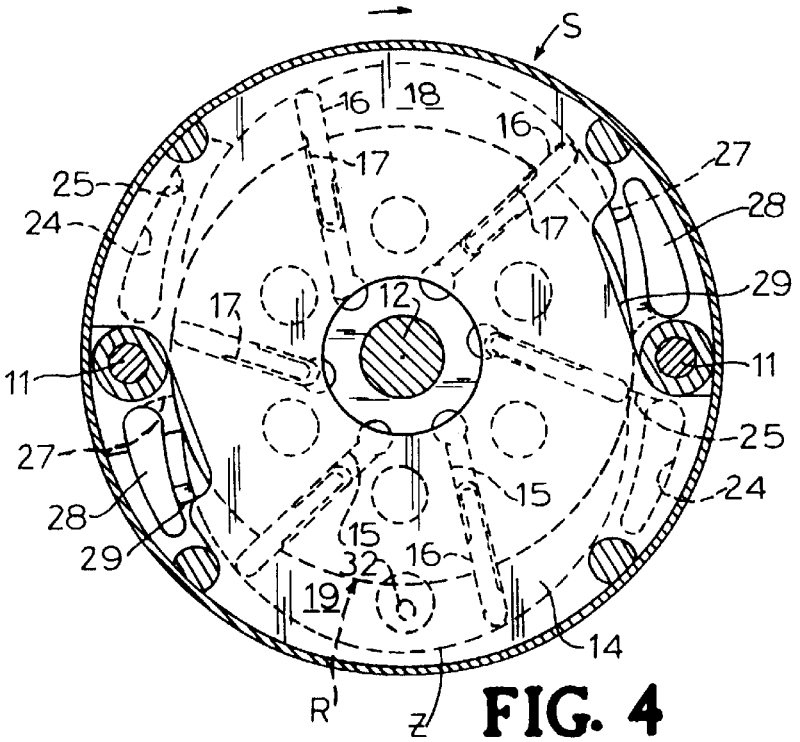
FIG. 4 is a transverse sectional view taken on the line 4—4 of FIG. 1.
Figure 5:
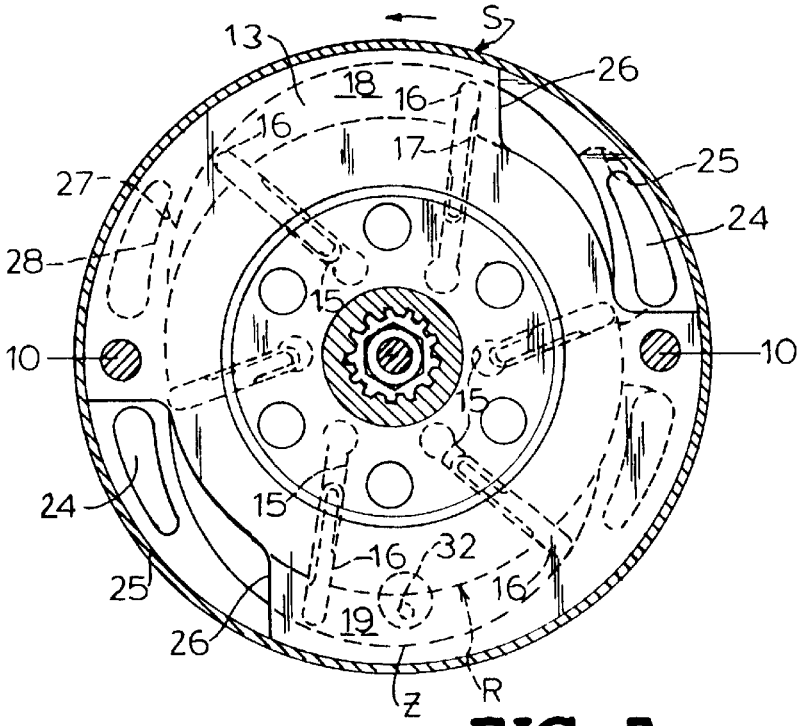
FIG. 5 is a transverse sectional view taken on the line 5—5 of FIG. 1.

Referring to FIGS. 4 and 5, stator S is provided with two symmetrically opposite lobes 18 and 19, the surfaces of which act as cams that regulate two extension and retraction cycles for the vanes 16 during each rotation of rotor R. The longitude spaces defined by adjacent vanes 16, rotor R, the surface of a stator lobe, and the end plates 13 and 14 serve as pumping pockets which are moved from an intake zone to an exhaust zone to accomplish the pumping action. Air enters pump P through an inlet fitting 20 in the front flange F and passes to an annular inlet chamber 21, also within the front flange F. The air is exhausted through an outlet fitting 22 in the back flange B which communicates with an outlet chamber 23, also formed in the back flange B.

Entering air passes from the inlet chamber 21 to one of two longitudinally extending inlet passages 24 in the stator S, which extend from end-to-end there through. Each inlet passage 24 communicates with the pumping pockets in stator lobes through a series of spaced slots 25 formed in the wall of the stator S (FIG. 1). The inlet end plate 13 has two inlet ports 26 which permit passage of the entering air from the inlet chamber 21 to each of the two inlet passages 24, and thereafter to the pumping pockets.

Air is exhausted from the pumping pockets through another series of spaced slots 27 in the stator wall which communicate with two longitudinally extending exhaust passages 28 on the opposite sides of the stator S. The floating discharge end plate 14 is provided with two outlet ports 29 to permit passage of compressed air to the two outlet passages 28 in stator S to the outlet chamber 23 in the back flange B.

Discharge end plate 14 is arranged to "float" in the back flange B in an axial direction. A helical spring 41 bears between the interior surface of the discharge end plate 14, and the back flange B and urges the end plate 14 against the end of the stator S to provide the end seal for the pumping pockets. Alternatively, as seen in FIG. 8, back flange B can be designed as a unitary element. Back flange B has a rear wall 30 integrally formed therein, and does not include a floating end plate 14. The floating characteristic of the end plate, however, is not essential to the invention.

Figure 6:
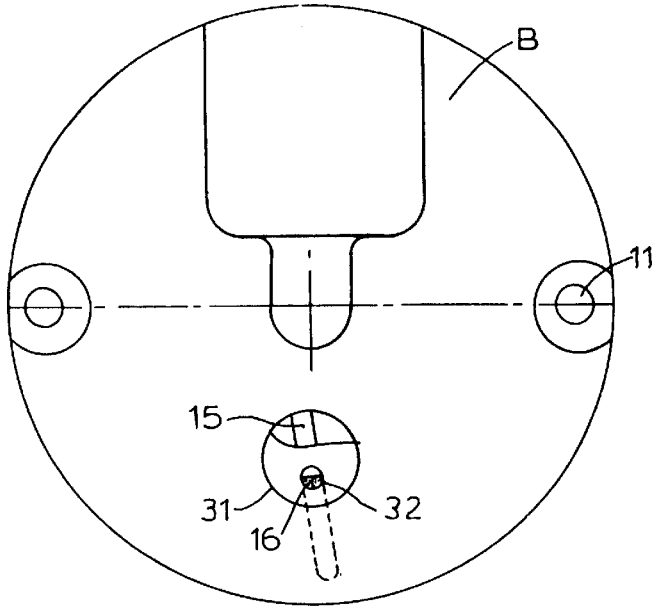
FIG. 6 is an end elevation of the rear flange including a view port according to an embodiment of the invention.
Figure 7:
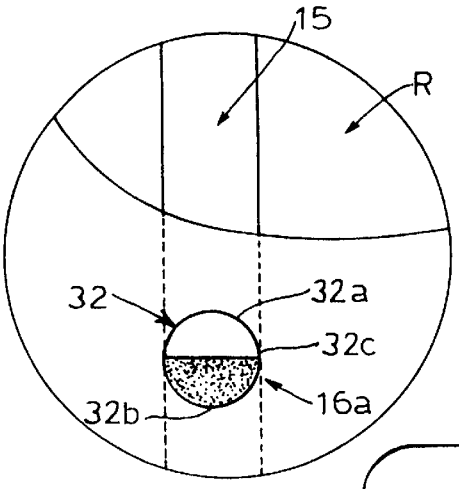
FIG. 7 is an enlarged view of the view port of FIG. 6.

FIGS. 5 and 7, and FIG. 8 illustrate respective first and second embodiments of the present invention. FIGS. 6 and 7 depict back flange B provided with a view port 31 and a calibrated or gauge hole 32 through which the inboard edge of the vane 16 can be seen under certain circumstances. The calibrated hole 32 is located such that after the pump has been operated for a predetermined number of hours, for example 800 hours, there is a high probability that the inboard edges of the pump vanes 16 will be observable in hole 32, one-by-one as the rotor is turned and the pump is oriented for observation. The observation may find the inboard edge of the vane 16 in an "upper" portion 32*a* (closest to the center of rotation of the rotor) of calibrated hole mid portion 32*c*, midway in the hole 32, or at the "bottom" portion 32*b* (farthest from the center of rotation of the rotor). The edge of the vane may not be visible in the calibrated hole at all, the edge being above or below the upper or lower edges of the hole 32, respectively.

The position of the inboard edge of vane 16 at a known point in the operational life of the pump (e.g.; 800 hours of service) provides useful information as to the present state of wear of the vanes and the rate of wear up to that time. If the inboard edge of the vane is visible and has not yet reached the upper edge 32*a* of the calibrated hole 32, the vane 16 has little wear, and the rate of wear, using the 800 hour example, would be considered unusually slow. If the inboard edge of vane 16 is visible in the hole 32 and is below the bottom edge 32*b* of the calibrated hole 32, the state of wear, again using the 800 hour example, would be very advanced, and the rate of wear to that point would be considered unusually rapid. In such a case, the pump should be replaced and removed from service. If the inboard edge of vane 16 appears in the approximate center 32*c* of the calibrated hole 32 as shown in FIG. 7, wear of the vane and rate of wear are probably within normal limits. When the vane inboard edge appears in the approximate center of the hole 32, an additional 200 hours of wear, under normal operating conditions, should be expected until the inboard edge of the vane appears adjacent to the bottom 32*b* of the hole. When the inboard edge of the vane reaches the bottom of the hole, pump replacement is warranted.

The diameter of the calibrated hole 32 should be approximately equal to the reduction of length of a vane 16 after about 400 hours of use under normal operating conditions. Thus, when the inboard edge of vane 16 appears at the top 32*a* of the calibrated hole, an additional 400 hours of pump use should be expected under normal wear conditions on the vane. Accordingly, periodic observation of the position of the vane inboard edge in the calibrated hole can help in determining the rate of wear of a vane, and by inference, the wear state, rate of wear of the pump, and the remaining useful life of the pump.

The radial location of the calibrated hole 32 should be selected to permit observation of each of vanes 16, one-by-one, as the rotor R is turned and when the vane is at a point of maximum extension in the slot, i.e., when the leading edge of vane 16 is in contact with the wall of the stator S as indicated by the letter Z in FIGS. 4 and 5. The position correlates with a segment of the pump stator's curve where vane extension is constant. Other radial locations of the calibrated hole may introduce significant errors. The distance from the rotor's centerline of rotation (and the pump's rotational centerline) correlates to a certain vane inboard edge position expected after a particular number of hours of operation at a normal wear rate. The diameter of the hole 32 corresponds to an expected amount of vane length wear over a period of time. That is, as the vane length decreases during pump use, the inboard vane edge will move radially outwardly in the slot.

Visual access to the calibrated hole 32, which is located in the inner wall 30 of the pump's back flange B (see FIG. 8), is gained by removing a cover, such as a threaded plug 33, from a larger view port 31 on the outside wall of back flange B. Plug 33 is preferably made from aluminum and is threaded in such a way that once tightened into the view port 31, plug 33 will be locked into position and not require any additional locking mechanism. Aluminum is the preferred material for the plug because its coefficient of thermal expansion is the same as the back flange B of the pump P, which is generally some form of anodized aluminum. This prevents undesirable strains and stress on back flange B of the pump during operation. Plug 33 is preferably coated with a corrosion preventing material, and the corresponding threaded hole in back flange B should also be treated to prevent galling between the two aluminum parts when assembled. Use of dissimilar metals for plug 33 and back flange B to prevent galling and overstraining the assembly when removing the plug could add weight or induce dissimilar metal corrosion or/and could induce undesirable stress through unequal coefficients of thermal expansion. The present inventive combination ensures weight reduction and avoidance of undesired stress. Furthermore, corrosion can be avoided through the use of innovative combinations of materials, treatments and thread design.

The above detailed description of a preferred embodiment of the invention sets forth the best mode contemplated by the inventor for carrying out the invention at the time of filing this application and is provided by way of example and not as a limitation. Accordingly, various modifications and variations obvious to a person of ordinary skill in the art to which it pertains are deemed to lie within the scope and spirit of the invention as set forth in the following claims.

What is claimed is:

1. A rotary vane pump, comprising:

(a) a housing within which is rotatably mounted a rotor having a plurality of radially-extending slots therein with a vane positioned for sliding movement within each of the slots; and (b) an access port in the housing communicating with the rotor through the housing, the access port being sized to define an opening sufficiently small to prevent withdrawal from the housing through the access port of a vane aligned with the access port and to permit detection through the access port of the position of the aligned vane relative to the access port for determining whether wear to the vane has met or exceeded a predetermined amount.

2. A rotary vane pump according to claim 1, wherein the vanes are mounted in the respective slots for centrifugal sliding movement.

3. A rotary vane pump according to claim 1, wherein the access port comprises a bore extending through the housing from an exterior surface to an interior surface thereof and having a dimension that, in relation to a width dimension of the slots, permits detection of the vane in the one slot when aligned with the bore.

4. A rotary vane pump according to claim 3, wherein the bore is positioned to permit visual observation of the vane in the slot aligned with the bore.

5. A rotary vane pump according to claim 1, and including a calibrated point defined by a location on a bearing surface in the housing against which the vanes bear during operation, and defining a point at which the vane in the one slot is positioned when the one slot is aligned with the access port.

6. A rotary machine, comprising:

(a) a housing within which is rotatably mounted a rotor having a plurality of radially-extending slots therein with a vane positioned for sliding movement within each of the slots;

(b) an access port in the housing communicating with the rotor at a reference position on the housing in relation to the slots, the access port being sized to:

(i) permit alignment of any one of the slots with the access port by rotating the rotor; and (ii) define an opening sufficiently small to prevent withdrawal from the housing through the access port of a vane aligned with the access port and maintain the vane within its range of radial movement in the slot;

whereby, by aligning the one slot with the access port and placing the vane in the one slot at a predetermined calibration point, a determination of whether wear to the vane has met or exceeded a predetermined amount can be determined by reference to the vane through the access port.

7. A method of determining wear to a vane of a rotary vane pump of the type having a plurality of vanes positioned for sliding movement within a plurality of respective, radially-extending slots formed in a rotor mounted for rotation in a pump housing, the method comprising the steps of:

(a) determining a reference position on the housing in relation to the slots;

(b) providing an access port in the pump housing at the reference position, the access port being sized to define an opening sufficiently small to prevent withdrawal from the housing through the access port of a vane aligned with the access port and to permit detection through the access port of the position of the aligned vane relative to the access port for determining whether wear to the vane has met or exceeded a predetermined amount;

(c) rotating the rotor to align one of the slots with the access port;

(d) moving the vane in the one slot to a predetermined calibration point; and (e) determining by reference to the vane through the access port whether wear to the vane has met or exceeded a predetermined amount.

8. A method according to claim 7, wherein the step of providing an access port comprises providing a bore extending through the housing from an exterior surface to an interior surface thereof and having a dimension that, in relation to a width dimension of the slots, permits detection of the vane in the one slot when aligned with the bore.

9. A method according to claim 7, wherein the step of determining by reference to the vane through the access port whether wear to the vane has met or exceeded a predetermined amount comprises the step of visually observing the position of the vane in the slot aligned with the bore.

10. A method according to claim 7, wherein step of determining the reference position comprises the stop of determining a location on a bearing surface in the housing against which the vanes bear during operation that defines a position at which the vane in the one slot is positioned when the one slot is aligned with the access port.

11. A method for modifying the housing of a rotary vane pump to determine the amount or rate of wear of vanes in the pump, comprising:

(a) determining a position in the rotary vane pump housing suited to locating a port that allows access to the vanes within the housing when the vanes are in a known position with respect to a wall of the housing; and (b) forming a sealable port at the determined position, said port adapted to have a gauge located within said port, and dimensioned such that a dimension of the gauge represents a predetermined amount of vane length loss.

12. A method for determining the rate of wear of vanes in a rotary vane pump comprising:

(a) selecting a rotary vane pump having a sealable port at a position in the housing of the pump that will allow access to the vanes within the housing when the vanes are in a known position with respect to a wall of the housing; and (b) locating a gauge within the port, the gauge being dimensioned such that a dimension of the gauge represents a predetermined amount of vane length loss.

* * * * *

UNITED STATES PATENT AND TRADEMARK OFFICE

CERTIFICATE OF CORRECTION

PATENT NO. : 6,565,337 B2
APPLICATION NO. : 10/195784
DATED : May 20, 2003
INVENTOR(S) : Timothy H. Henderson It is certified that error appears in the above-identified patent and that said Letters Patent is hereby corrected as shown below:

Column 9, line 2, delete “comprises the stop” and insert -- comprises the step -- .

Signed and Sealed this

Seventh Day of August, 2007

JON W. DUDAS
*Director of the United States Patent and Trademark Office*

UNITED STATES PATENT AND TRADEMARK OFFICE

CERTIFICATE OF CORRECTION

PATENT NO. : 6,565,337 B2
APPLICATION NO. : 10/195784
DATED : May 20, 2003
INVENTOR(S) : Timothy H. Henderson It is certified that error appears in the above-identified patent and that said Letters Patent is hereby corrected as shown below:

Column 9, line 2, delete “comprises the stop” and insert -- comprises the step --.

Signed and Sealed this

Twenty-first Day of August, 2007

JON W. DUDAS
*Director of the United States Patent and Trademark Office*